US010105750B2

(12) United States Patent
Rixen et al.

(10) Patent No.: US 10,105,750 B2
(45) Date of Patent: Oct. 23, 2018

(54) METHOD FOR PRODUCING A BLIND HOLE IN A METALLIC BODY

(71) Applicants: Wolfgang Rixen, Solingen (DE); Gerrit Pies, Solingen (DE)

(72) Inventors: Wolfgang Rixen, Solingen (DE); Gerrit Pies, Solingen (DE); Tobias Geisler, Solingen (DE)

(73) Assignees: Wolfgang Rixen, Solingen (DE); Gerrit Pies, Solingen (DE)

( * ) Notice: Subject to any disclaimer, the term of this patent is extended or adjusted under 35 U.S.C. 154(b) by 415 days.

(21) Appl. No.: 14/765,848

(22) PCT Filed: Jan. 25, 2014

(86) PCT No.: PCT/EP2014/000196

§ 371 (c)(1),
(2) Date: Aug. 5, 2015

(87) PCT Pub. No.: WO2014/121899

PCT Pub. Date: Aug. 14, 2014

(65) Prior Publication Data

US 2015/0367403 A1 Dec. 24, 2015

(30) Foreign Application Priority Data

Feb. 5, 2013 (DE) ..... 10 2013 001 918

(51) Int. Cl.
*B21J 5/06* (2006.01)
*B21K 23/00* (2006.01)
(Continued)

(52) U.S. Cl.
CPC ..... *B21J 5/06* (2013.01); *B21J 5/002* (2013.01); *B21K 1/64* (2013.01); *B21K 23/00* (2013.01)

(58) Field of Classification Search
CPC . B21K 23/00; B21K 1/64; B23P 15/00; F16B 37/00; B21D 28/24; B21D 28/26;
(Continued)

(56) References Cited

U.S. PATENT DOCUMENTS 3,645,521 A * 2/1972 Geen ..... B21D 26/08 266/249
5,502,994 A 4/1996 Katoh et al.
(Continued)

FOREIGN PATENT DOCUMENTS

DE 197 53 069 A1 6/1999
DE 103 17 185 A1 11/2004
(Continued)

OTHER PUBLICATIONS

Machine translation of DE10317185A1 is attached.*

*Primary Examiner* — A. Dexter Tugbang
*Assistant Examiner* — John S Lowe
(74) *Attorney, Agent, or Firm* — Gudrun E. Huckett

(57) ABSTRACT

A method for producing a blind hole in a metallic workpiece having at least one curved surface. One part of the material is pushed starting from approximately the horizontally extending curved tangent and from there approximately perpendicular in the direction of the material of the workpiece by means of reciprocating movement. Said method consists of the following steps: a) providing the workpiece with a matrix-type receiving element for the material which is to be displaced; b) pushing the workpiece material by means of a stamp in the axial direction of the receiving element, said material stamped by the stamp is initially sheared in an adiabatic state and flows partially into the receiving element; c) removing the material projecting from the receiving element.

11 Claims, 1 Drawing Sheet

(51) Int. Cl.
*B21K 1/64* (2006.01)
*B21J 5/00* (2006.01)

(58) Field of Classification Search
CPC .. B21D 28/34; B21D 22/02; B21J 9/04; B21J 9/06
See application file for complete search history.

(56) References Cited

U.S. PATENT DOCUMENTS

| | | | | |
|---|---|---|---|---|
| 6,571,596 | B1 * | 6/2003 | Lindell | B21F 23/00 72/339 |
| 2002/0043090 | A1 | 4/2002 | Miyahara | |

FOREIGN PATENT DOCUMENTS

| | | | | |
|---|---|---|---|---|
| DE | 10317185 | A1 * | 11/2004 | B23D 23/00 |
| DE | 10 2007 036 708 | A1 | 4/2008 | |
| WO | 2011/098250 | A1 | 8/2011 | |

* cited by examiner

METHOD FOR PRODUCING A BLIND HOLE IN A METALLIC BODY

BACKGROUND OF THE INVENTION

The invention concerns, as an alternative to drilling, a method for producing a blind hole in a metallic workpiece comprising at least one curved surface, wherein machining is done beginning approximately at the horizontal tangent and approximately transverse thereto in the direction of the material of the workpiece.

In conventionally drilled blind holes cuttings are produced inevitably. Moreover, such bores can be introduced only at a limited speed.

Increasing the drilling speed is not possible with conventional means. Also, it must be considered that the workpieces must be cleaned and deburred, which requires additional time.

Up to now, no evidence has been found that a blind hole can be produced without a drill.

The invention has therefore the object to develop a method that enables providing metallic bodies with blind holes with high precision and also with a significantly increased speed.

SUMMARY OF THE INVENTION

This object is solved by the following method:

Method for producing a blind hole in a metallic workpiece comprising at least one curved surface, wherein, beginning approximately at the horizontally extending curvature tangent and approximately transverse thereto in the direction of the material of the workpiece, by means of a stroke movement a part of the material is displaced, comprising the steps:

a) providing the workpiece with a die-shaped receptacle for the material to be displaced;

b) displacing the material of the workpiece by means of a plunger (18) in axial direction of the receptacle, wherein the material that is impacted by the plunger (18) is initially cut in an adiabatic state and partially flows into the receptacle; and c) removal of the material projecting into the receptacle.

The gist of the invention resides in transferring the corresponding material locations in the metallic body into an adiabatic state in order to avoid plastic deformations at the impact area. For this purpose, no drill is required that wears quickly. Moreover, in this context, no cuttings are produced that may cause processing disturbances.

A further embodiment of the invention provides that the diameter of the receptacle is smaller than the diameter of the plunger.

This enables a precise adjustment of the depth and width of the blind hole because due to the smaller diameter of the receptacle the material can be driven out in the correct ratio so that still sufficient material for formation of the blind hole bottom is remaining. Also, the protrusion of the plunger relative to the receptacle provides an annular area that cannot be displaced too quickly so that this annular area ensures that a bottom area remains after the stamping or stroke process.

Preferably, it is provided that the receptacle for the displaced material is arranged above the workpiece.

Moreover, it has been found to be advantageous when the impact speed is <10 m/s, preferably 6 m/s up to 8 m/s, which is sufficient for producing the adiabatic state.

Particularly advantageously, the impact speed is 7 m/s.

This is in contrast to the disclosure of the publication DE 103 17 185 where it is disclosed that the adiabatic state is generated only at a stroke speed of more than 10 m/s.

It is particularly advantageous when the cross-section of the metallic workpiece is of a triangular or semi-circular shape, has at least one rounded corner, and the blind bore extends beginning at the highest point of the curvature transversely to the line that is connecting the two remaining corners.

A further embodiment of the invention provides that the workpiece is supplied as elongate material with desired cross-section to the processing station for producing the blind hole and is then adiabatically cut to length to the final size, or is adiabatically individualized to the final size already beforehand and supplied to the processing station.

It has been found to be particularly advantageous when this method is used for producing sliding blocks.

In this context, it is advantageous when this sliding block is also provided with a through hole by using the method for producing through holes according to the simultaneously filed and pending patent application DE 10 2013 001 919.2 "Method for producing a through hole in a metallic body", filed on Feb. 5, 2013, by applicant.

Finally, it can also be provided to first produce the through holes and then the blind holes.

BRIEF DESCRIPTION OF THE DRAWINGS

Further advantages and features of the invention result from the following description of an embodiment as well as from the drawings to which reference is being had. It is expressly noted that the description is based on manufacturing a sliding block but is in no way limited thereto. It is shown in.

DESCRIPTION OF PREFERRED EMBODIMENTS

With the aid of FIGS. 1 to 4, the manufacture or the method for producing a blind hole 10 within, in this case, a metallic sliding block 12 that has a curved surface is disclosed. It is again noted that the description of the sliding block is only given as an example because the method according to the invention of course can also be applied to and used for other metallic bodies with curved surfaces.

Figure 1:
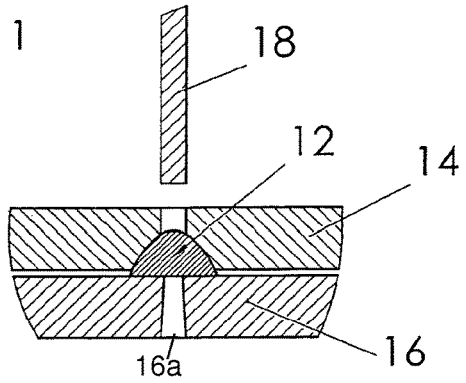
FIG. 1 a cross-section of the initial situation which is viewed at the site marked with the large arrow transversely to the manufacturing line.

FIG. 1 shows the initial position for an adiabatic displacement of a blind hole 10. The workpiece 12, which is of course a sliding block 12 in this case, is received in such a way in a holder 14 that the rounded portion of the cross-section that is in this case of a semi-circular shape is oriented downward. The workpiece 12 to be processed is secured on its topside by a receptacle 16 provided with a cutout or a cavity 16*a* for the material to be displaced (see 12*a* in FIG. 3) in alignment with a plunger 18.

The sliding block 12 or the section not yet machined is thus secured from above and from below.

From the schematically illustrated sequence of manufacturing steps in all FIGS. 1 to 4 it can be seen that so-called through holes are produced beforehand and also are provided with a thread.

In all FIGS. 1 to 4, the large arrow always points in the direction of the section that is illustrated as a great cross-section.

Figure 2:
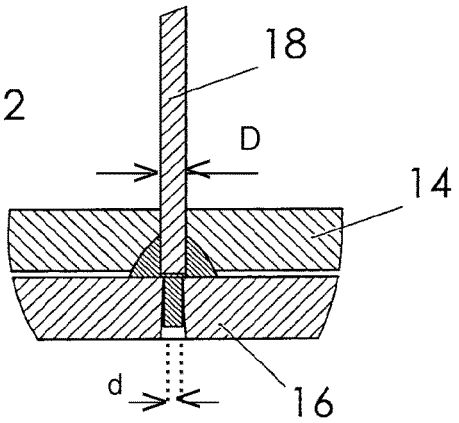
FIG. 2 shows a cross-section similar to FIG. 1 wherein however the plunger already has penetrated into the metallic body, in this case the sliding block.

Beginning with the position according to FIG. 1, by means of a plunger 18 the material of the workpiece is now displaced in axial direction of the receptacle 16, as illustrated in FIG. 2, wherein the material impacted by the plunger 18 is transferred into an adiabatic state and is partially displaced into the cavity 16 provided therefore.

Figure 3:
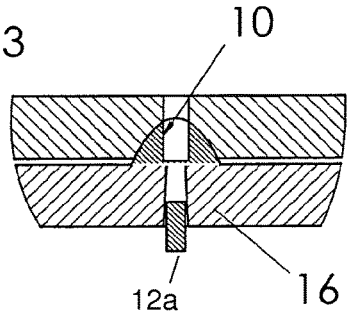
FIG. 3 a view similar to FIG. 2, wherein however the plunger has been completely inserted into the metallic body and the pin received in the receptacle according to the drawing is to be sheared off to the right and can be removed through the blind hole.

Subsequently, according to FIG. 3, the receptacle 16 can now be displaced freely to the right because the plunger 18 has already been pulled out of the blind hole 10.

Figure 4:
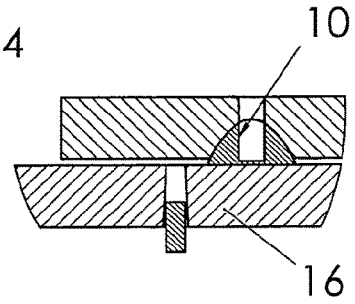
FIG. 4 a view similar to FIG. 3 wherein the receptacle contents has already been removed through the blind hole.

The receptacle 16 according to FIG. 4 is moved to the right to such an extent that the sheared-off pin reaches the through hole Du and in this way can drop downwardly.

In order to prevent that upon stamping or displacement of the excess material into the receptacle 16 the material that is in the adiabatic state is pushed through the surface of the sliding block 12 so that a hole is produced, the diameter d of the cavity 16 a in the receptacle 16 is smaller than the diameter D of the plunger 18. Therefore, essentially a small ring is formed in the area of the sliding block 12 which is essentially retained by the smaller diameter d of the opening of the receptacle 16. The receptacle 16 therefore secures an annular part of the future bottom of the blind hole 10 of the sliding block 12.

It is of course also possible to arrange the arrangement in reverse compared to FIGS. 1 to 4. However, it has been found to be advantageous when the receptacle 16 for the displaced material is arranged above the workpiece 12.

Even though, as already explained in the introduction, the publication DE 103 17 185 A1 expressly states that an adiabatic state occurs only at speeds of more than 10 m/s, it has been found for the illustrated arrangement that also lower speeds of, for example, 6 m/s to 8 m/s and preferably 7 m/s can be employed in order to obtain an adiabatic state for the punching process.

In contrast to the semi-circular workpieces 12 illustrated in FIGS. 1 to 4 it is however also possible that the cross-section of the metallic workpiece 12 is triangular wherein at least one rounded corner is existing which can be used for entry of the plunger or stamp 18 for generating the blind hole 10.

FIGS. 1 to 4 show also that the manufacture of the metallic workpieces 12, in this case the sliding blocks 12, as a starting material a long wire with the aforementioned cross-sections can be used in order to be able to employ an assembly line-type processing. It is however also possible to cut to length beforehand the defined workpieces 12 and then supply them in appropriate rails, like on an assembly line, to the individual processing stations.

The sliding block 12 is also provided with a through hole by using the method for producing through holes according to the simultaneously filed and pending patent application "Method for producing a through hole in a metallic body", filed on Feb. 5, 2013 (DE 10 2013 001 919.2).

By means of the invention it is now made possible to produce blind holes that have a flat bottom and no longer the conical depressions which are produced upon drilling. In particular in case of the sliding blocks, this has the advantage that the springs that are inserted into the blind holes for supporting a ball are always seated with precise fit and cannot move; of course, with the exception of the spring travel. In order to secure the balls placed onto the springs within the blind hole, the outer walls of the blind hole are swedged.

LIST OF REFERENCE NUMBERS

10 blind hole
12 workpiece
14 holder
16 receptacle
18 plunger
D diameter

What is claimed is:

1. A method for producing a blind hole in a metallic workpiece having at least one curved surface, comprising the steps:

a) placing the workpiece in a holder having an opening, positioning the holder having the workpiece into a receptacle comprising a cavity having a central axis aligned with a plunger and the opening of the holder, and positioning the workpiece such that a base of the workpiece is facing the cavity of the receptacle and the at least one curved surface is facing the opening of the holder and the plunger, the at least one curved surface having a tangent to a highest point of the curvature of the at least one curved surface and the tangent extends horizontally;

b) displacing a portion of a material of the metallic workpiece partially into the cavity of the receptacle, in a direction transverse to the tangent toward the base of the metallic workpiece, by impacting the material of the metallic workpiece with the plunger in a direction along the central axis of the cavity of the receptacle by a stroke movement and shearing off in an adiabatic state the portion of the material of the metallic workpiece that is impacted by the plunger to form the blind hole that extends from the at least one curved surface toward the base; and c) separating the material of the metallic workpiece which is projecting into the cavity of the receptacle from the workpiece.

2. The method according to claim 1, further comprising selecting a diameter (d) of the cavity of the receptacle to be smaller than a diameter (D) of the plunger.

3. The method according to claim 1, further comprising impacting the plunger at an impact speed of 6 m/s to 8 m/s for reaching the adiabatic state.

4. The method according to claim 3, wherein the impact speed is 7 m/s.

5. A method for producing a blind hole in a metallic workpiece having at least one curved surface, comprising the steps:

selecting a cross-section of the metallic workpiece to be of a triangular or semi-circular shape comprising at least one rounded corner and two remaining corners of the triangular or semi-circular shape;

placing the workpiece in a holder having an opening, positioning the holder having the workpiece into a receptacle comprising a cavity having a central axis aligned with a plunger and the opening of the holder, and positioning the workpiece such that the at least one rounded corner is facing the opening of the holder and the plunger and the two remaining corners are facing the cavity of the receptacle and a tangent to a highest point of the curvature of the at least one rounded corner extends horizontally;

displacing a portion of the material of the metallic workpiece partially into the cavity of the receptacle, in a direction transverse to the tangent toward the two remaining corners, by impacting the material of the metallic workpiece with the plunger in a direction along the central axis of the cavity of the receptacle by a stroke movement and shearing off in an adiabatic state the portion of the material of the metallic workpiece that is impacted by the plunger; and removing the material of the metallic workpiece which is projecting into the cavity of the receptacle;

wherein the blind hole extends, beginning at the highest point of the curvature of the at least one rounded corner, transversely to a line connecting the two remaining corners of the triangular or semi-circular shape.

6. The method according to claim 1, further comprising supplying elongate material with a desired cross-section to a processing station for producing the blind hole and adiabatically cutting to length the elongate material to a final size of the metallic workpiece.

7. The method according to claim 1, further comprising adiabatically individualizing from an elongate material with a desired cross-section the metallic workpiece of a final size and subsequently supplying the metallic workpiece to a processing station for producing the blind hole.

8. The method according to claim 1, wherein the metallic workpiece is a sliding block.

9. A method for producing a blind hole in a metallic sliding block having at least one curved surface, comprising the steps:

placing the sliding metallic block in a holder having an opening, positioning the holder having the metallic sliding block into a receptacle comprising a cavity having a central axis aligned with a plunger and the opening of the holder, and positioning the sliding block such that a base of the sliding block is facing the cavity of the receptacle and the at least one curved surface is facing the plunger and the opening of the holder, the at least one curved surface having a tangent to a highest point of the at least one curved surface and the tangent extends horizontally;

displacing a portion of the material of the metallic sliding block partially into the cavity of the receptacle, in a direction transverse to the tangent toward the base of the metallic sliding block, by impacting the material of the metallic sliding block with the plunger in a direction along the central axis of the cavity of the receptacle by a stroke movement and shearing off in an adiabatic state the portion of the material of the metallic sliding block that is impacted by the plunger;

removing the material of the metallic sliding block which is projecting into the cavity of the receptacle; and producing a through hole in the sliding block.

10. The method according to claim 9, wherein the through hole is formed first and then the blind hole is produced in the sliding block.

11. The method according to claim 9, wherein the blind hole is formed first and then the through hole is produced in the sliding block.

* * * * *